US005778786A

United States Patent [19]

Metrope

[11] Patent Number: 5,778,786

[45] Date of Patent: Jul. 14, 1998

[54] PLATE CLAMPING DEVICE FOR REDUCING THE NON-PRINTING REGION

[75] Inventor: Jacques Metrope, Laigneville, France

[73] Assignees: Heidelberger Druckmaschinen AG, Heidelberg, Germany; Heidelberg Harris SA, Montataire Cedex, France

[21] Appl. No.: 686,357

[22] Filed: Jul. 25, 1996

[30] Foreign Application Priority Data

Jul. 25, 1995 [FR] France ..... 95 09001

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 948,157 | 1/1910 | Bevan | 101/415.1 |
| 2,837,025 | 6/1958 | Pechy | 101/415.1 |
| 2,900,904 | 8/1959 | Hantscho | 101/415.1 |
| 3,125,023 | 3/1964 | Skinner et al. | 101/415.1 |
| 3,276,365 | 10/1966 | Langer | 101/415.1 |
| 3,362,327 | 1/1968 | Luehrs | 101/415.1 |
| 5,062,363 | 11/1991 | Reichel | 101/415.1 |
| 5,483,891 | 1/1996 | Reichel | 101/415.1 |

FOREIGN PATENT DOCUMENTS

| | | |
|---|---|---|
| 0 453 794 A1 | 10/1991 | European Pat. Off. . |
| 0 531 741 A1 | 3/1993 | European Pat. Off. . |
| 0 585 625 A1 | 3/1994 | European Pat. Off. . |
| 0 592 856 A1 | 4/1994 | European Pat. Off. . |
| 1265837 | 11/1958 | France . |

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

A device for securing printing forms on the circumference of a printing form cylinder, wherein a leading edge and a trailing edge of a printing form are receivable in a gap formed in the printing form cylinder and, in a clamped or locked-up state of the printing form, engage respective side faces defining the gap, including a rotatable cross-bar received in the gap, and a clamping element for acting upon one of the edges of the printing form, the clamping element being secured to the cross-bar, further includes a protrusion formed on a side wall having one of the faces defining the gap of the printing form cylinder, the clamping element being cooperable with the protrusion for clamping a printing form edge in a tangential direction to the printing form cylinder during a clamping or locking process.

8 Claims, 3 Drawing Sheets

PLATE CLAMPING DEVICE FOR REDUCING THE NON-PRINTING REGION

BACKGROUND OF THE INVENTION

Field of the Invention

The invention relates to a plate clamping device for reducing the non-printing or print-free region on the circumference of a printing form cylinder in a printing unit of a rotary printing press.

The published European Patent Document EP 0 585 625 A1 is concerned with a device for fastening a flexible printing plate. A plurality of leaf-shaped springs are inserted into a cylinder gap and have two legs which rest in the gap, one of the legs being elongated and clamping the edges of the printing plate.

The published European Patent Document EP 0 531 741 A1 is concerned with a leading-edge fastener for a printing plate in printing presses. A clamping device has two flat clamping faces extending perpendicularly to the cylinder radius and permitting the leading edge of the printing plate to be fastened without any material deformation. This is achieved by providing that the radius of the outer cylindrical surface of the plate cylinder in the vicinity of the opening for the introduction of the printing plate be smaller than the cylinder radius, and that the cylinder radius be at least large enough so that, when clamping or locking-up a commercially available printing plate, no permanent deformation thereof can occur.

From the published European Patent Document EP 0 592 856 A1, a locking device for securing a printing form to the outer cylindrical or jacket surface of a cylinder has become known heretofore. A locking device is supposed to be manufactured at relatively low expense, is supposed to enable rapid clamping with little exertion of force, and is supposed to stress the printing form as little as possible, so that the printing form can be used many times. A resilient element with two legs is secured to a clamping shaft disposed in a cylinder gap; in the prestressed state, the first leg, which is the leg trailing in the direction of rotation of the cylinder, protrudes freely into the gap, and the other leg protrudes past the first leg in radial direction. This embodiment also provides that the trailing end of the printing form, which is folded or bent away at an obtuse angle, rest on an axially protruding edge which is a component of the trailing gap-defining side surface. The use of this catching device lends itself especially well to web-fed rotary printing presses.

The published European Patent Document EP 0 453 794 A1 is concerned with a method and a device for securing a printing plate to a cylinder with a narrow gap. A printing plate with an elongated end portion is received in a narrow gap of a cylinder and is held on a curved side wall defining the gap by a clamping element filled with yielding or resilient material. The clamping element presses the elongated end portion of the printing plate against the side wall in a direction normal to the side wall, in order to reduce the longitudinal strain on the end portion. The leading edge of the printing form is secured to the opposite side of the gap. When the plate is dismantled or disassembled from the cylinder, the elongated end portion is removed first from the gap of the printing form cylinder.

In the construction according to the aforementioned European Patent Document EP 0 453 794 A1, it is necessary to manufacture printing forms with an elongated end portion which has two kinks formed therein, in order to attain a curvature thereof in the direction of one side wall of the gap.

SUMMARY OF THE INVENTION

It is accordingly an object of the invention to provide a plate clamping device which permits a minimizing of the cylinder or lock-up gap required to secure the end portions of the printing form to a printing form cylinder, and thus reduces the non-printing region on the circumferential surface of the printing form cylinder.

With the foregoing and other objects in view, there is provided, in accordance with the invention, a device for securing printing forms on the circumference of a printing form cylinder, wherein a leading edge and a trailing edge of a printing form are receivable in a gap formed in the printing form cylinder and, in a clamped or locked-up state of the printing form, engage respective side faces defining the gap, including a rotatable cross-bar received in the gap, and a clamping element for acting upon one of the edges of the printing form, the clamping element being secured to the cross-bar, comprising a protrusion formed on a side wall having one of the faces defining the gap of the printing form cylinder, the clamping element being cooperable with the protrusion for clamping a printing form edge in a tangential direction to the printing form cylinder during a clamping or locking process.

In accordance with another feature of the invention, the side wall formed with the protrusion is also formed with a chamfer.

In accordance with a further feature of the invention, the clamping element is in linear engagement with the printing form edge.

In accordance with an added feature of the invention, the protrusion extends over the width or breadth of the printing form cylinder.

In accordance with an additional feature of the invention, the protrusion in the side wall has a hardened surface.

In accordance with yet another feature of the invention, the protrusion is formed on a rod-shaped element embedded in the side wall and extending axially over the width or breadth of the printing form cylinder.

In accordance with yet a further feature of the invention, the clamping element is partly embedded resiliently in the cross-bar.

In accordance with yet an added feature of the invention, the clamping element, in a state thereof wherein it clamps the printing form, is positioned resiliently against the printing form edge and is locked in position.

In accordance with a concomitant feature of the invention, the clamping element, during respective mounting and dismantling of the printing form, maintains the leading edge of the printing form in a provisional clamping position in the gap formed in the printing form cylinder.

Due to the foregoing construction of the device according to the invention, it is possible, in a relatively simple manner for one of the printing form edges to be pulled in a tangential direction towards the other of the printing form edges opposite thereto, during a clamping operation, through the cooperation of a protrusion formed in a side wall defining a gap formed in a printing form cylinder. Because the width of the opening or mouth of the cylinder gap can be reduced in this manner, the non-printing zone in the printed product is consequently reduced as well. This avoids any requirement for a printing form having form or plate-edge end portions of different lengths.

In a further construction of the device according to the invention, the side wall formed with the protrusion is also formed with a chamfer. The printing form which is to be clamped linearly engages the protrusion, so that the tangential tensile force is introduced into the printing form uniformly over the width or breadth of the cylinder. Moreover, the protrusion extends over the entire width or breadth of the printing form; in the vicinity of the protrusion, the side wall defining the gap may be provided with a hardened coating. An especially wearproof material in the form of a strip or rod may also be embedded in the side wall so that it forms the protrusion about which the printing form edge is pulled when the printing form is being clamped on the outer cylindrical or jacket surface of the cylinder.

The clamping element which linearly engages the printing form edge to be clamped, is partly embedded resiliently in a rotatable cross-bar disposed in a lower part of the gap formed in the printing form cylinder. In the state wherein the printing form edge is clamped, the clamping element can be positioned resiliently against the printing form edge and locked in position.

Other features which are considered as characteristic for the invention are set forth in the appended claims.

Although the invention is illustrated and described herein as embodied in a plate clamping device for reducing the non-printing region on the circumference of a printing form cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
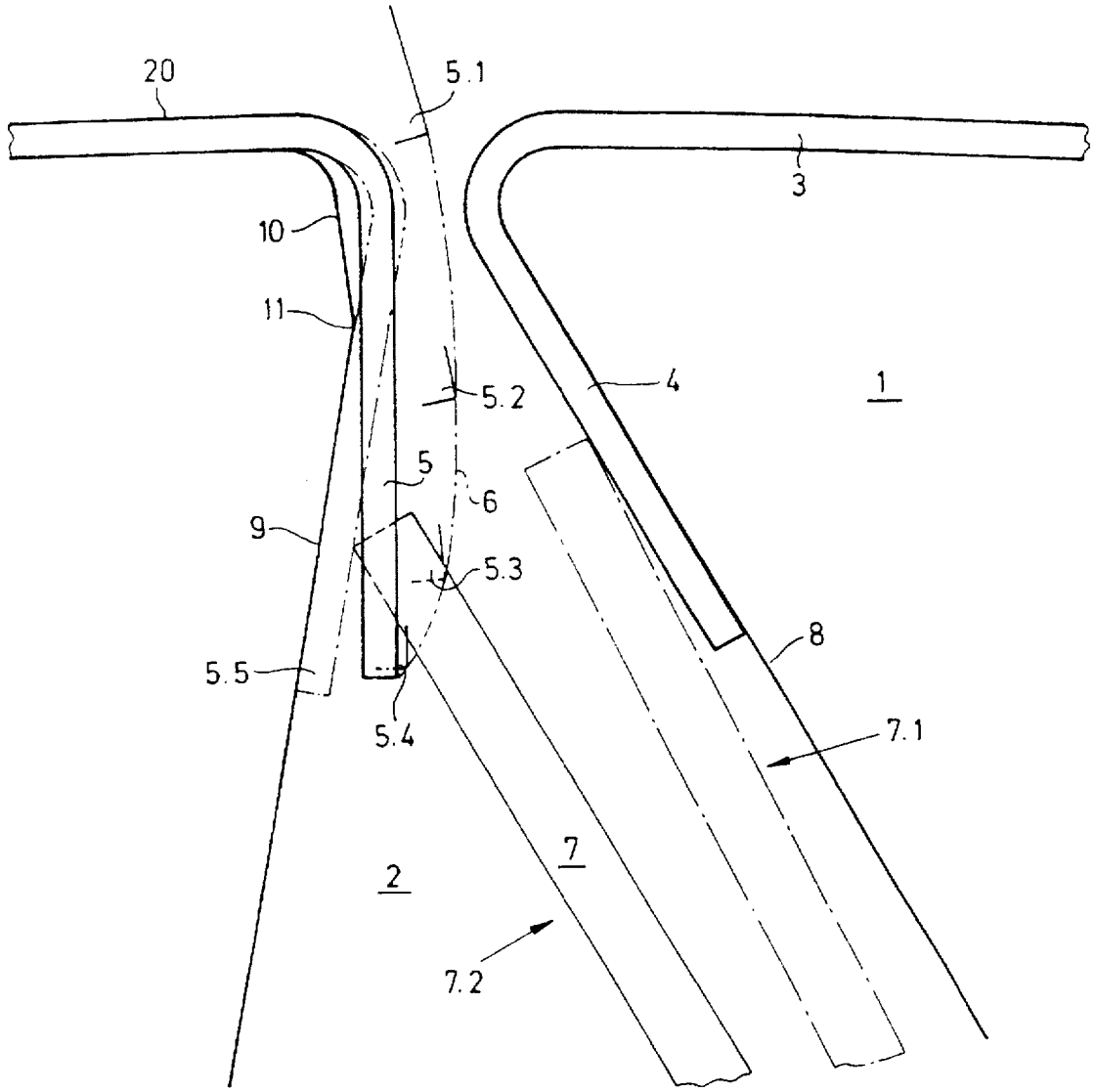
FIG. 1 is a fragmentary side elevational view of a printing form cylinder showing the cylinder gap formed therein, together with ends of a printing form received in the cylinder gap.

Referring now to the drawings and, first, particularly to FIG. 1 thereof, there is shown therein a greatly enlarged detail of the gap of a printing form cylinder.

Figure 3:
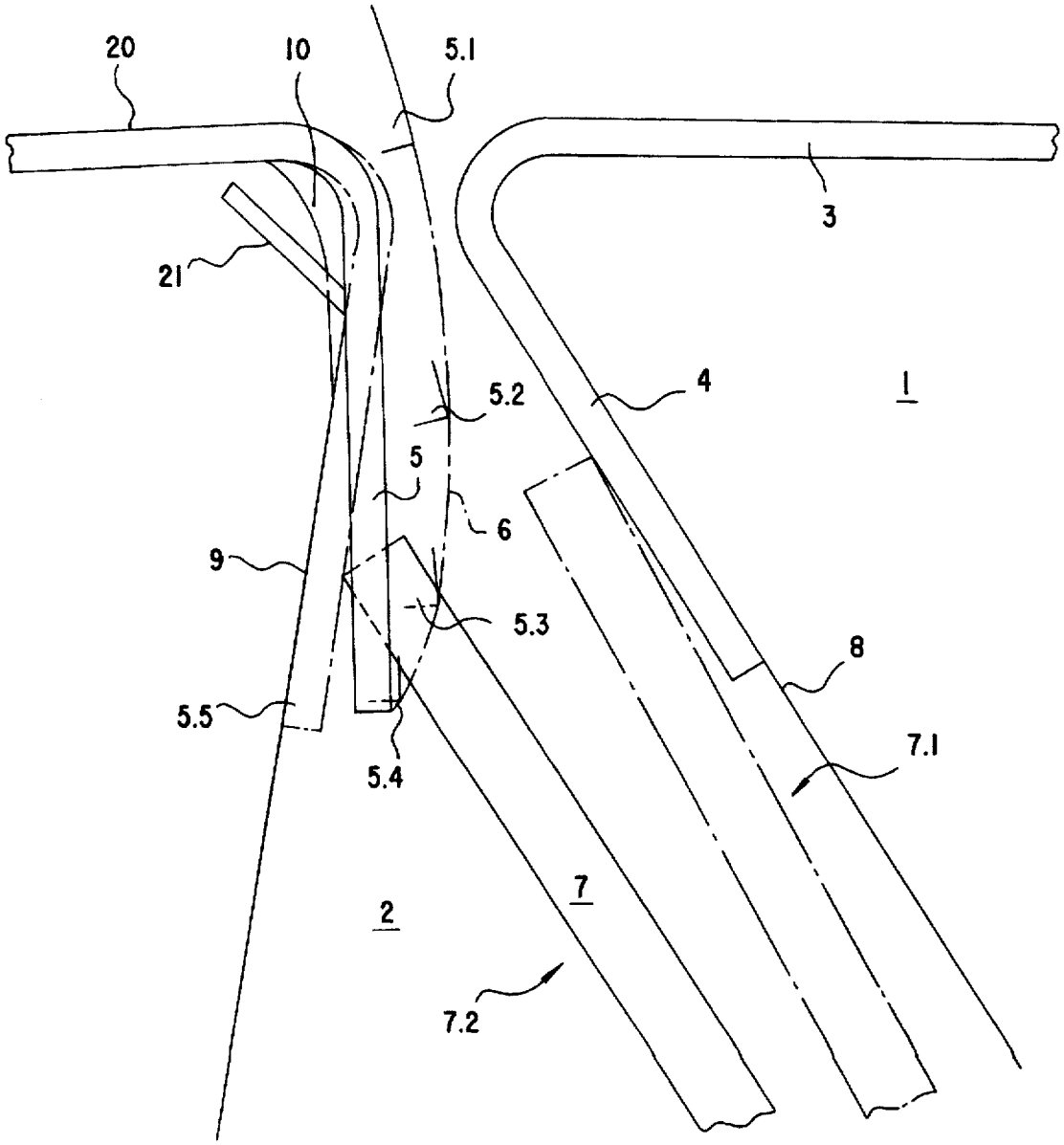
FIG. 3 is fragmentary side elevational view of the printing form cylinder showing the cylinder gap formed therein and a rod-shaped element embedded in a side wall of the printing form cylinder.

A printing-unit cylinder 1, in this case a printing form cylinder, is formed with a cylinder gap 2, which extends parallel to the axis of rotation of the printing form cylinder. Respective ends of a printing form 3, i.e., a leading edge 4 and a trailing edge 5 of the printing form, assuming that the cylinder 1 rotates counter-clockwise, i.e., from the right-hand side of FIG. 1 to the left-hand side thereof, are suspended in the gap 2. The leading edge 4 of the printing form 3 is in engagement with a leading side wall 8 defining the gap 2, while the trailing edge 5 of the printing form 3 which, in the clamped or locked-up state is represented in phantom as 5.5, rests on a trailing side wall 9 further defining the cylinder gap 2. After the leading edge 4 of the printing form 3 has been suspended in the gap 2, as shown, the trailing edge 5 of the printing form 3 is moved successively through infeed positions 5.1, 5.2 and 5.3 thereof until it reaches the position 5.4. The trailing edge 5 of the printing form 3 describes an imaginary path during the insertion process which is represented by the phantom or dot-dash line 6. In the view of FIG. 1, it is apparent that one of the side walls 8, 9, in this case the side wall 9, defining the gap 2 is formed with a recess 10, below which a protrusion 11 is formed. Both the recess 10 and the protrusion 11 extend over the entire width or breadth of the printing form cylinder 1. The side wall 9 defining the gap 2 may be hardened to prevent wear in the region of the protrusion 11 by means of a conventional hardening process. It is also conceivable to provide a strip a bar or rod-shaped element 21 or a similar body of wearproof material, extending parallel to the axis of rotation of the cylinder 1 and having a protrusion 11, as in FIG. 1, in the side wall 9 defining the gap 2 as shown in FIG. 3.

In a lower region of the gap 2 in FIG. 1, a clamping or locking element 7 is provided, which is movable from a provisional clamping or locking position 7.1 into a clamping or locking position 7.2 and back again. In the provisional clamping position 7.1, the leading edge 4 of the printing form 3 is fixed. While the printing form 3 is being placed upon the circumference of the printing form cylinder 1, the leading edge 4 is secured in this manner. During disassembly or dismantling of the printing form 3 from the printing unit cylinder 1, as well, the leading edge 4 of the printing form 3 is retained by the clamping or locking element in the provisional clamping position 7.1 thereof. If the clamping element 7 is set into the position 7.2 thereof, i.e., the locking position, the result is a linearly extending contact at the contact location between the clamping or locking element 7 and the trailing edge 5 of the printing form 3. During the clamping or lock-up operation performed on the trailing edge 5, the region of the trailing edge 5 of the printing form 3 extending beyond the protrusion 11 moves into a stop position 5.5 thereof, shown in phantom. The protrusion 11 acts as a pivot point about which the trailing edge 5 moves, so that the circumferential surface 20 of the printing form 3 moves in a direction towards the middle of the gap 2. Because of the pivoting motion of the trailing edge 5 about the protrusion 11, a tangentially acting force is introduced into the printing form 3, which effects a reduction in the non-printing or print-free opening or mouth of the gap 2, because the leading edge 4 and the trailing edge 5 of the printing form 3 move towards one another on the circumference of the printing form cylinder 1.

After the trailing edge 5 of the printing form 3 has been moved by the clamping or locking element 7 into the stop position 5.5, the printing form 3 is clamped on the outer cylindrical or jacket surface of the printing form cylinder 1. The clamping element 7 is then locked in its clamping position 7.2, so that the fastening of the printing form 3 is maintained. The clamping element 7 may likewise extend over the width of the channel 2 in the printing form cylinder 1 or may be formed of individual resilient tongues. When the trailing edge 5 of the printing form 3 is in its stop position 5.5, the clamping element 7 is then positioned resiliently against it.

Figure 2:
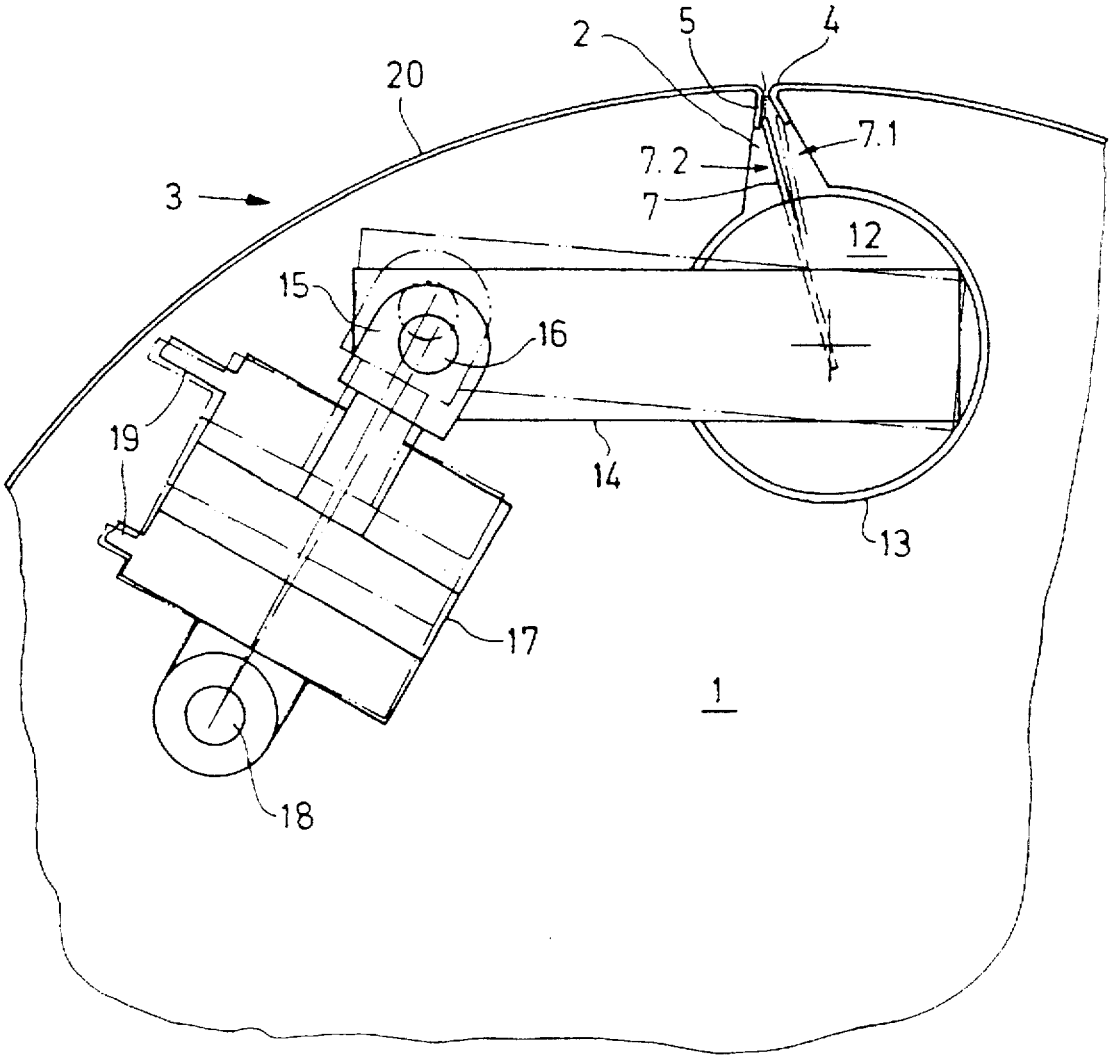
FIG. 2 is a fragmentary side elevational view of a printing form cylinder which is of a smaller scale than that of FIG. 1 and shows the device according to the invention and an arrangement for actuating the device.

FIG. 2 shows a larger detail of the end face of a printing form cylinder. The leading edge 4 and the trailing edge 5 of the printing form 3 are shown on a smaller scale than in FIG. 1, as is the clamping or locking element 7 in the positions 7.1 and 7.2 thereof. The clamping element 7, whether it is one continuous component or a plurality of individual tongues, is received in a cross-bar 12, which is rotatable in a bore 13 formed in the printing form cylinder 1. The cross-bar 12 is provided with a lever 14, which is pivotable via an adjusting device 17, such as a pneumatic cylinder. A bolt 16 is provided at the end of the lever 14 remote from the cross-bar 12 and extends through both the lever 14 and a fork 15, the fork 15 being adjustable by the adjusting device 17. The adjusting device 17 itself may be held in a rotatable support 18 at an end face of the printing form cylinder 1, however, an arrangement at both end faces of the printing form cylinder 1 would also be conceivable. In the embodiment of the invention shown in FIG. 2, the adjusting device 17 is a pneumatic cylinder having chambers which are acted upon by a pressure medium via connections or unions 19. An electric motor or an hydraulic cylinder or the like could also be used to actuate the cross-bar 12.

In FIG. 2, the positions of the components 17, 15, 16, 14 and 7 shown in solid lines represent the clamping or locking position 7.2 wherein the trailing edge 5 of the printing form 3 is clamped or locked by the clamping or locking element 7, while the positions shown in phantom or dot-dash lines for the components 17, 15, 16, 14 and 7 represent the provisional clamping position 7.1 wherein the leading edge 4 of the printing form 3 is clamped by the clamping element 7.

I claim:

1. A printing form cylinder device for receiving printing forms on the circumference of the printing form cylinder device, the printing forms having a leading edge and a trailing edge, the printing form cylinder device, comprising:

a printing cylinder body having a leading side wall, a trailing side wall and a gap formed therein, said leading side wall and said trailing side wall forming borders of said gap and said gap receiving a leading edge and a trailing edge of a printing form;

one of said leading side wall and said trailing side wall having a protrusion formed therein for assisting in pivoting and turning in the printing form;

a rotatable cross bar received in said gap;

a clamping element secured to said rotatable cross bar, apparatus mounting said clamping element to be movable so as to alternatively lock the leading edge of the printing form to said leading side wall and the trailing edge of the printing form to said trailing side wall; and said clamping element engaging one of the edges of the printing form below said protrusion producing a tangentially acting force which moves the trailing edge toward the leading edge to reduce the space between them.

2. Device for securing printing forms according to claim 1, wherein said one of said leading side wall and said trailing side wall formed with said protrusion is also formed with a recess.

3. Device for securing printing forms according to claim 1, wherein the clamping element is in linear engagement with the printing form edge.

4. Device for securing printing forms according to claim 1, wherein said protrusion extends over the entire width or breadth of the printing form cylinder.

5. Device for securing printing forms according to claim 1, wherein said side wall having said protrusion has a hardened surface relative to said claimping element.

6. Device for securing printing forms according to claim 1, wherein said protrusion is formed on a rod-shaped element embedded in said side wall and extending axially over the entire width or breadth of the printing form cylinder.

7. Device for securing printing forms according to claim 1, wherein the clamping element is partly embedded in the cross-bar.

8. Device for securing printing forms according to claim 1, wherein the clamping element, in a state thereof wherein it clamps the printing form, is positioned resiliently against the printing form edge and is clamped in position.

* * * * *